United States Patent [19]

DePalma

[11] 4,020,904

[45] May 3, 1977

[54] DISPERSION NOZZLE WITH REMOVABLE DISPERSION ELEMENT

[76] Inventor: Joseph S. DePalma, P.O. Box 353, Closter, N.J. 07624

[22] Filed: Dec. 3, 1975

[21] Appl. No.: 637,154

[52] U.S. Cl. ..... 169/74; 169/77

[51] Int. Cl.[2] ..... A62C 13/24

[58] Field of Search ..... 169/74, 26, 88, 89, 169/77

[56] References Cited

UNITED STATES PATENTS

| | | | |
|---|---|---|---|
| 2,562,930 | 8/1951 | Mapes | 169/77 X |
| 2,605,848 | 8/1952 | Carter | 169/77 X |
| 2,674,325 | 4/1954 | Siebens | 169/89 |
| 2,736,385 | 2/1956 | Siebens | 169/74 |
| 3,662,836 | 5/1972 | Siimes | 169/89 |
| 3,719,231 | 3/1973 | Haggard | 169/89 X |
| 3,776,313 | 12/1973 | DePalma | 169/26 X |

*Primary Examiner*—Johnny D. Cherry
*Assistant Examiner*—Michael Mar
*Attorney, Agent, or Firm*—Clarence A. O'Brien; Harvey B. Jacobson

[57] ABSTRACT

A nozzle construction including inlet and outlet ends is provided and the inlet end of the nozzle is adapted to be secured in the discharge port of a fire extinguisher. The outlet end of the nozzle is of a configuration designed to afford a stream-type discharge of any fire extinguishing material (dry chemical powder, liquid and/or pressurized gas) therefrom, whereby the fire extinguisher may be hand held and have the discharge from its nozzle directed toward the base of a fire to be extinguished. However, the nozzle is designed to be utilized on a heat sensing and automatic fire extinguisher of the wall type and the outlet end of the nozzle includes a discharge dispersion element removably supported therefrom and designed, when retained in position, to effect a wide dispersion of the stream of any fire extinguishing material being discharged through the nozzle. The purpose for widely dispersing the stream discharge of fire fighting material from the fire extinguisher as a result of its automatic operation when wall mounted is to enable the discharge of the fire extinguisher to completely saturate a room area into which the fire extinguisher is automatically discharged and the purpose of the removal dispersion element being to enable removal of the latter for the purpose of manually fighting a localized fire.

2 Claims, 4 Drawing Figures

DISPERSION NOZZLE WITH REMOVABLE DISPERSION ELEMENT

BACKGROUND OF THE INVENTION

There are various types of automatic fire fighting systems which are actuated by excessive heat. One type of automatic fire fighting system involves the utilization of heat sensing actuators and discharge nozzles which are capable of widely dispersing the pressure discharge of fire fighting material from the nozzle whereby the fire fighting material may be widely dispersed for extinguishing a fire within a room without an attendant to operate the fire extinguisher. In addition, it is conventional for manual fire extinguishers to be wall mounted in a manner for ready removal of the fire extinguisher and manual operation of the fire extinguisher against a localized fire.

Recently, development has been made in the provision of wall mounted dry powder fire extinguishers equipped with automatic heat sensing valves for actuation of the fire extinguishers in response to a rise in temperature above a predetermined level. Of course, such wall mounted fire extinguishers are provided with dispersion nozzles whereby the dry powder automatically discharged into a room where a fire is present substantially entirely inundates the room with dry powder in order that a fire may be extinguished in any area of the room.

While the use of automatic actuators on wall mounted dry powder fire extinguishers represents a considerable advance, a localized fire may not be best fought with a dry powder extinguisher of the type equipped with a dispersion nozzle designed to inundate a room upon automatic actuation. A fire may best be manually fought by a fire extinguisher capable of directing a stream of dry powder onto the base of the fire.

Examples of various forms of wall mounted fire extinguishers of various types are disclosed in U.S. Pat. Nos. 398,643, 578,703, 543,341, 758,362 and 2,620,038.

BRIEF DESCRIPTION OF THE INVENTION

The nozzle of the instant invention includes an outlet end of an internal configuration designed to provide a stream discharge of dry powder. However, the nozzle includes a transverse dispersion element removably secured to the outlet end thereof and which is operative, when retained in position, to widely disperse the otherwise stream discharge of powder. The nozzle is to be used on a fire extinguisher capable of self-actuation in response to a temperature rise and in this manner the fire extinguisher, upon sensing a rise in temperature, may automatically discharge a widely dispersed discharge of powder into a room upon whose interior wall the fire extinguisher is mounted. On the other hand, should a localized fire develop and it is desirable to remove the fire extinguisher from the wall and to fight the localized fire manually, the utilization of a dispersion-type nozzle is undesirable. Accordingly, the dispersion element on the nozzle is readily removable therefrom to enable the associated fire extinguisher to be manually operated against a localized fire with the extinguisher being capable of discharging a stream of dry powder to the base of the fire.

The main object of this invention is to provide a nozzle for dry powder fire extinguishers and which may be used not only to widely disperse discharge of powder from the nozzle in the event of automatic operation of the fire extinguisher but to also enable the nozzle to be substantially instantly modified to provide a stream discharge of dry powder to thus enable the fire extinguisher to be manually used against a localized fire.

Another object of this invention, in accordance with the immediately preceding object is to provide a nozzle with a dispersion element supported therefrom, spring biased toward disengagement therefrom and having a simple releasable latch retaining the dispersion element against displacement from the nozzle.

Yet another object of this invention is to provide the latch for retaining the dispersion element in position on the nozzle with a tether member whose remote end is anchored to the safety pin for the manually operable actuating lever of the fire extinguisher, whereby when the safety pin is withdrawn the latch for the dispersion element will be released to thereby enable the spring biased dispersion element to be ejected from the nozzle.

A final object of this invention to be specifically enumerated herein is to provide a fire extinguisher nozzle construction in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
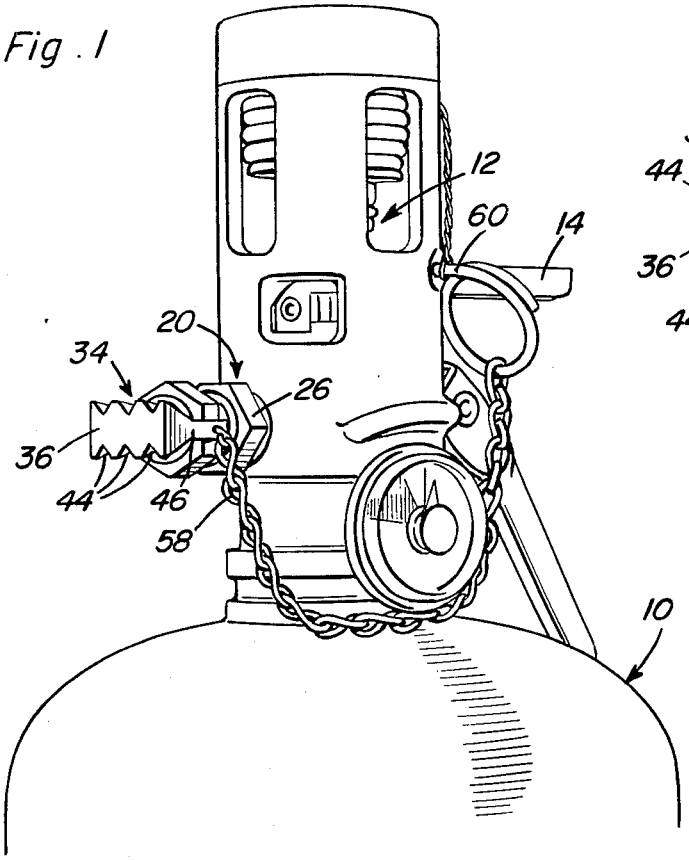
FIG. 1 is a perspective view of the upper portion of a dry powder fire extinguisher of the automatic actuating type and with the nozzle of the fire extinguisher equipped with a removal dispersion element tethered to the safety pin of the manually operable actuating lever of the fire extinguisher.

Referring now more specifically to the drawings, the numeral 10 generally designates a dry chemical powder fire extinguisher which is operable automatically upon being subject to an increase in ambient temperature above a predetermined temperate and which may also be actuated manually. The fire extinguisher 10 includes a temperature rise responsive actuating mechanism referred to in general by the reference numeral 12 and a manually operable lever 14 which may have its free end depressed downwardly in order to manually discharge the fire extinguisher 10. The extinguisher 10 includes a discharge port 16 provided with a threaded counterbore 18 and the nozzle of the instant invention is referred to in general by the reference numeral 20 and is secured in counterbore 18.

The nozzle 20 includes an externally threaded inlet end 22 threadedly engaged in the counterbore 18 and an outlet end 24 with an enlarged intermediate portion 26 of hexagonal cross-section in order to enable conventional tools to be uitlized in threading the inlet end 32 into the counterbore 18. The nozzle 20 has a longitudinal bore 28 formed therethrough including a counterbore 30 of increased diameter extending through the outlet end 24. The outlet 24 is also provided with a pair of diametrically opposite and aligned radial bores 32 for purposes to be hereinafter more fully set forth.

A discharge dispersion assembly is referred to in general by the reference numeral 34 and includes a triangular transverse element 36 spaced outwardly of the outlet end 24. The triangular element 36 includes one apex portion 38 extending across the outer end of the counterbore 30 and facing toward the inlet end 22 of the nozzle 20. The sides 40 and 42 of the element 36 which converge toward each other to form the apex 38 are provided with divergent grooves 44 and thus a jet discharge of dry chemical powder through the bore 28 and striking the element 36 causes the dry chemical powder to be widely dispersed in a manner described in greater detail in my Prior U.S. Pat. No. 3,895,759.

Figure 2:
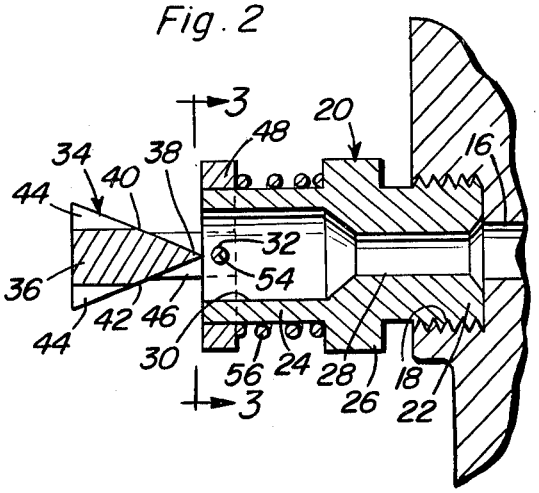
FIG. 2 is a fragmentary enlarged vertical sectional view taken substantially upon a plane passing longitudinally through the center of the discharge nozzle of the fire extinguisher.

The opposite ends of the element 36 include legs 46 extending in the direction in which the apex 38 faces and the legs 46 are carried by diametrically opposite portions of a ring 48 slidingly disposed on the exterior of the outlet end 24 but having aligned diametrically opposite bores 52 formed therethrough and registered with the bores 32, a locking pin 54 being passed through the registered bores 32 and 52 whereby the ring 48 and the element 36 supported therefrom are retained on the outlet end 24 of the nozzle 20. However, a stiff compression spring 56 is mounted on the outlet end portion 24 between the intermediate portion 26 and the ring 48 under a compressed state and thereby strongly yieldingly biases the dispersion assembly 34 to the left as viewed in FIG. 2. Of course, while the pin 54 is retained in position, the dispersion assembly 34 may not be removed from the nozzle 20. The pin 54 has one end of a tether member 58 anchored thereto and the end of the tether member 58 remote from the pin 54 is anchored to a lever safety pin 60 which must be removed in order to allow the lever 14 to be depressed downwardly for the purpose of manually actuating the fire extinguisher.

Figure 3:
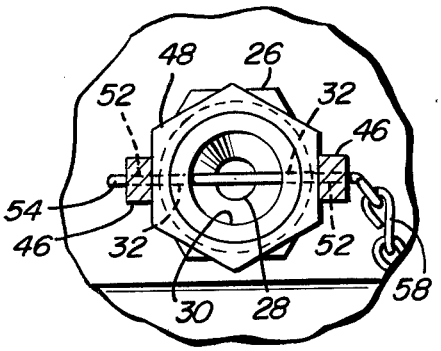
FIG. 3 is a sectional view taken substantially upon the plane indicated by the section line 3—3 of FIG. 3.
Figure 4:
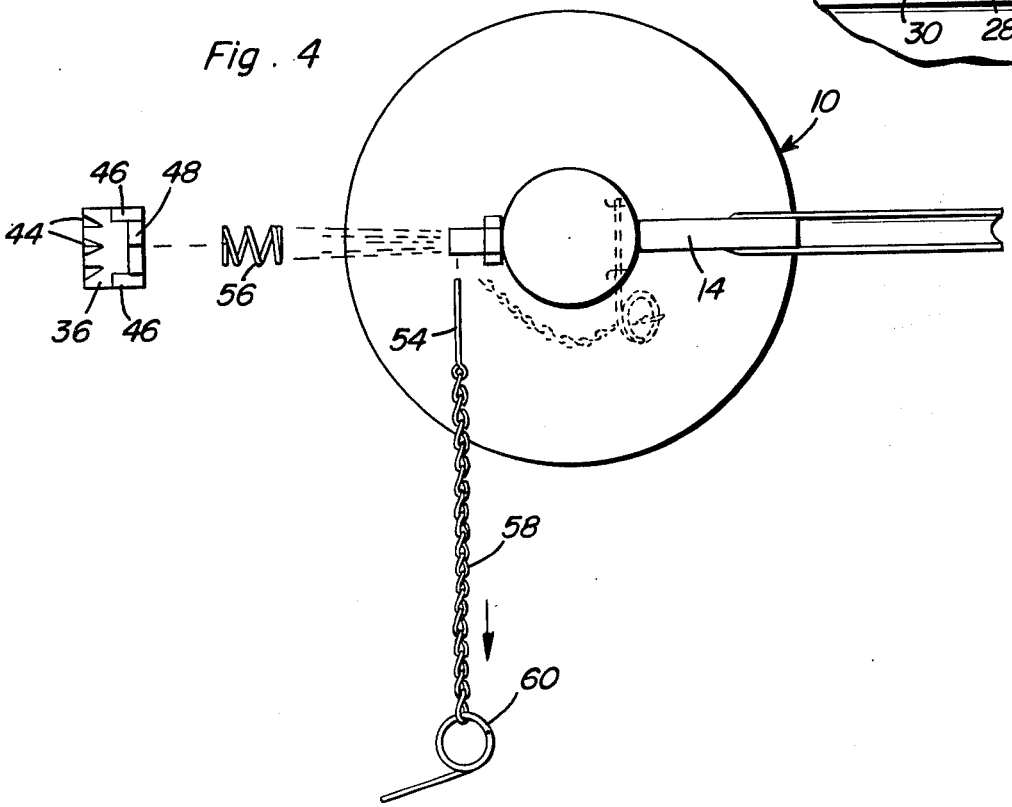
FIG. 4 is a top plan view of the fire extinguisher illustrating the manner in which removal of the lever safety pin also effects release of the dispersion element of the fire extinguisher nozzle by spring action in order to convert the nozzle from a dispersion nozzle to a stream discharge nozzle.

From a comparison of FIGS. 1 and 3 of the drawings, it will be seen that a sharp pull on the pin 60, as is conventional to release the lever 14 for manual operation, will also result in the pin 54 being withdrawn from the bores 32 and 52 and thereby enable the spring 56 to eject the dispersion assembly 34 off the outlet end 24 of the nozzle 20.

As hereinfore set forth, when the dispersion assembly 34 is in position, the discharge of dry chemical powder through the nozzle 20 is greatly dispersed so as to substantially inundate the room in which the fire extinguisher 10 is mounted. This dispersion type discharge is, of course, desirable when the fire extinguisher is wall mounted and automatically actuated as a result of a rise in ambient temperature. However, if it is desirable to remove the fire extinguisher 10 from its wall mounted position, perhaps to fight a fire in an adjacent room, the fire extinguisher 10 is removed from its wall mount in the conventional manner and the pin 60 is pulled whereby the tether member 58 will also pull the pin 54 to automatically eject the dispersion assembly 34 from the nozzle 20. Thereafter, depression of the lever 14 will cause the fire exinguisher 10 to be discharged and the discharge of dry chemical powder through and from the nozzle 20 will be in the form of a concentrated stream of dry chemical powder. In this manner, the operation of the extinguisher may direct substantially all of the discharge from the extinguisher 10 onto the base of the fire being fought.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a fire extinguisher of the type including a discharge port for discharging a fire extinguishing material under pressure, a nozzle having a discharge passage extending therethrough having inlet and outlet ends, said nozzle being supported from said fire extinguisher with said inlet end communicating with said port, said passage being adapted to discharge a stream-type discharge from said outlet end, and a dispersion element removably supported from said nozzle in registry with said outlet end for dispersing said stream-type discharge, said fire extinguisher including automatic thermal responsive discharging means and manually operable discharging means, said manually operable discharging means including a manual operator shiftable between active and inactive positions, a first axially removable pin releasably retaining said manual operator in said inactive position, said dispersion element being removably secured to said nozzle against removal therefrom by means of a second axially removable pin, an elongated flexible tether member tethering said pins extending transversely through said nozzle passage together, said pins generally paralleling each other and being axially removable in the same direction whereby continued pulling on one pin in the direction effecting its removal will also result in removal of the other pin, said dispersion element, upon removal of the corresponding pin, being freely disengageable from said nozzle and spring means operably connected between said nozzle and said element yielding biasing the latter outwardly from said nozzle in the direction in which said outlet end of said passage opens.

2. The combination of claim 1 wherein said fire extinguisher is of the dry chemical powder type.

* * * * *